US010744380B2

(12) United States Patent
Sander et al.

(10) Patent No.: US 10,744,380 B2
(45) **Date of Patent: *Aug. 18, 2020**

(54) GOLF CLUBS AND GOLF CLUB HEADS

(71) Applicant: KARSTEN MANUFACTURING CORPORATION, Phoenix, AZ (US)

(72) Inventors: Raymond J. Sander, Benbrook, TX (US); Robert M. Boyd, Flower Mound, TX (US); John T. Stites, Sallisaw, OK (US); Hiromitsu Akiyama, Tokyo (JP)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/405,908

(22) Filed: May 7, 2019

(65) Prior Publication Data

US 2019/0262676 A1 Aug. 29, 2019

Related U.S. Application Data

(63) Continuation of application No. 15/960,244, filed on Apr. 23, 2018, now Pat. No. 10,307,650, which is a continuation of application No. 14/705,267, filed on May 6, 2015, now Pat. No. 9,987,532, which is a continuation of application No. 13/906,645, filed on May 31, 2013, now Pat. No. 9,033,814.

(60) Provisional application No. 61/653,651, filed on May 31, 2012.

(51) Int. Cl.

| | |
|---|---|
| ***A63B 53/06*** | (2015.01) |
| ***A63B 53/04*** | (2015.01) |
| ***A63B 71/06*** | (2006.01) |

(52) U.S. Cl.

CPC ..... *A63B 53/06* (2013.01); *A63B 53/047* (2013.01); *A63B 2053/0433* (2013.01); *A63B 2053/0479* (2013.01); *A63B 2053/0491* (2013.01); *A63B 2071/0694* (2013.01)

(58) Field of Classification Search

CPC ..... A63B 53/06; A63B 53/047; A63B 2053/0433; A63B 2071/0694; A63B 2053/0491; A63B 2053/0479

USPC ..... 473/324–350, 287–292, 244–248

See application file for complete search history.

(56) References Cited

U.S. PATENT DOCUMENTS

| | | | |
|---|---|---|---|
| 2,652,256 | A | 9/1953 | Thomas |
| 3,979,125 | A | 9/1976 | Lancellotti |
| 5,407,202 | A | 4/1995 | Igarashi |
| 7,749,100 | B2 | 7/2010 | Tavares et al. |
| 8,721,472 | B2 | 5/2014 | Kuan et al. |

(Continued)

*Primary Examiner* — Sebastiano Passaniti

(57) ABSTRACT

Golf club heads which may include an iron-type golf club head body and an adjustable member configured to be engaged with iron-type golf club head body. The adjustable member may include a first surface and a second surface. The first surface of the adjustable member may form at least a portion of the sole of the iron-type golf club head and at least a portion of the rear of iron-type golf club head when the adjustable member is engaged with the iron-type golf club head body in a first orientation. Additionally, the second surface of the adjustable member may form at least a portion of the sole of the iron-type golf club head and at least a portion of the rear of iron-type golf club head when the adjustable member is engaged with the iron-type golf club head body in a second orientation, which is different from the first orientation.

20 Claims, 8 Drawing Sheets

(56) References Cited

U.S. PATENT DOCUMENTS

| | | | | |
|---|---|---|---|---|
| 8,740,722 | B2 | 6/2014 | Sato | |
| 8,821,307 | B2 | 9/2014 | Park et al. | |
| 9,033,814 | B2 | 5/2015 | Stites et al. | |
| 9,987,532 | B2 | 6/2018 | Sander et al. | |
| 10,307,650 | B2 * | 6/2019 | Sander | A63B 53/047 |
| 2013/0165251 | A1 | 6/2013 | Jorgensen | |
| 2013/0324299 | A1 | 12/2013 | Clausen et al. | |
| 2017/0095707 | A1 * | 4/2017 | Ripp | A63B 53/047 |

* cited by examiner

GOLF CLUBS AND GOLF CLUB HEADS

RELATED APPLICATION

This is a continuation of U.S. patent application Ser. No. 15/960,244, filed Apr. 23, 2018, which is a continuation of U.S. patent application Ser. No. 14/705,267, now U.S. Pat. No. 9,987,532, filed May 6, 2015, which is a continuation of U.S. patent application Ser. No. 13/906,945, now U.S. Pat. No. 9,033,814, filed on May 31, 2013, which claims the benefit of U.S. Patent Application No. 61/653,651 filed on May 31, 2012, which applications are incorporated by reference herein in their entirety and made a part hereof.

FIELD OF THE DISCLOSURE

The present disclosure relates to golf clubs and golf club heads. Particular example aspects of this disclosure relate to iron-type golf clubs and iron-type golf club heads.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

While the industry has witnessed dramatic changes and improvements to golf equipment in recent years, there is room in the art for further advances in golf club technology.

SUMMARY OF THE DISCLOSURE

The following presents a general summary of aspects of the disclosure in order to provide a basic understanding of the disclosure and various aspects of it. This summary is not intended to limit the scope of the disclosure in any way, but it simply provides a general overview and context for the more detailed description that follows.

Golf club heads according to at least some example aspects of this disclosure include: an iron-type golf club head including an iron-type golf club head body, a ball striking face, or face plate, and an adjustable or removable portion. Further, according to aspects of the disclosure, the adjustable member may be configured to be engaged with iron-type golf club head body and the adjustable member may include a first surface and a second surface. Further, when adjustable member is engaged with iron-type golf club head body, the adjustable member may form at least a portion of a sole of the iron-type golf club head and at least a portion of a rear of iron-type golf club head. Also, the first surface of the adjustable member may form at least a portion of the sole of the iron-type golf club head and at least a portion of the rear of iron-type golf club head when the adjustable member is engaged with the iron-type golf club head body in a first orientation. Additionally, the second surface of the adjustable member may form at least a portion of the sole of the iron-type golf club head and at least a portion of the rear of iron-type golf club head when the adjustable member is engaged with the iron-type golf club head body in a second orientation, which is different from the first orientation.

Additional aspects of this disclosure relate to golf club structures that include golf club heads, e.g., of the types described above. Such golf club structures further may include one or more of: a shaft member attached to the club head (optionally via a separate hosel member or a hosel member provided as an integral part of one or more of the club head or shaft); a grip or handle member attached to the shaft member; additional weight members; etc.

Still additional aspects of this disclosure relate to methods for producing golf club heads and golf club structures, e.g., of the types described above. Such methods may include, for example: (a) providing a golf club head of the various types described above, e.g., by manufacturing or otherwise constructing the golf club head body, by obtaining the golf club head body from another source, etc.; and (b) engaging a shaft member with the golf club head. Other steps also may be included in these methods, such as engaging a grip member with the shaft member, club head body finishing steps, etc.

BRIEF DESCRIPTION OF THE DRAWINGS

The present disclosure is illustrated by way of example and not limited in the accompanying figures, in which like reference numerals indicate similar elements throughout, and in which.

Figure 1:
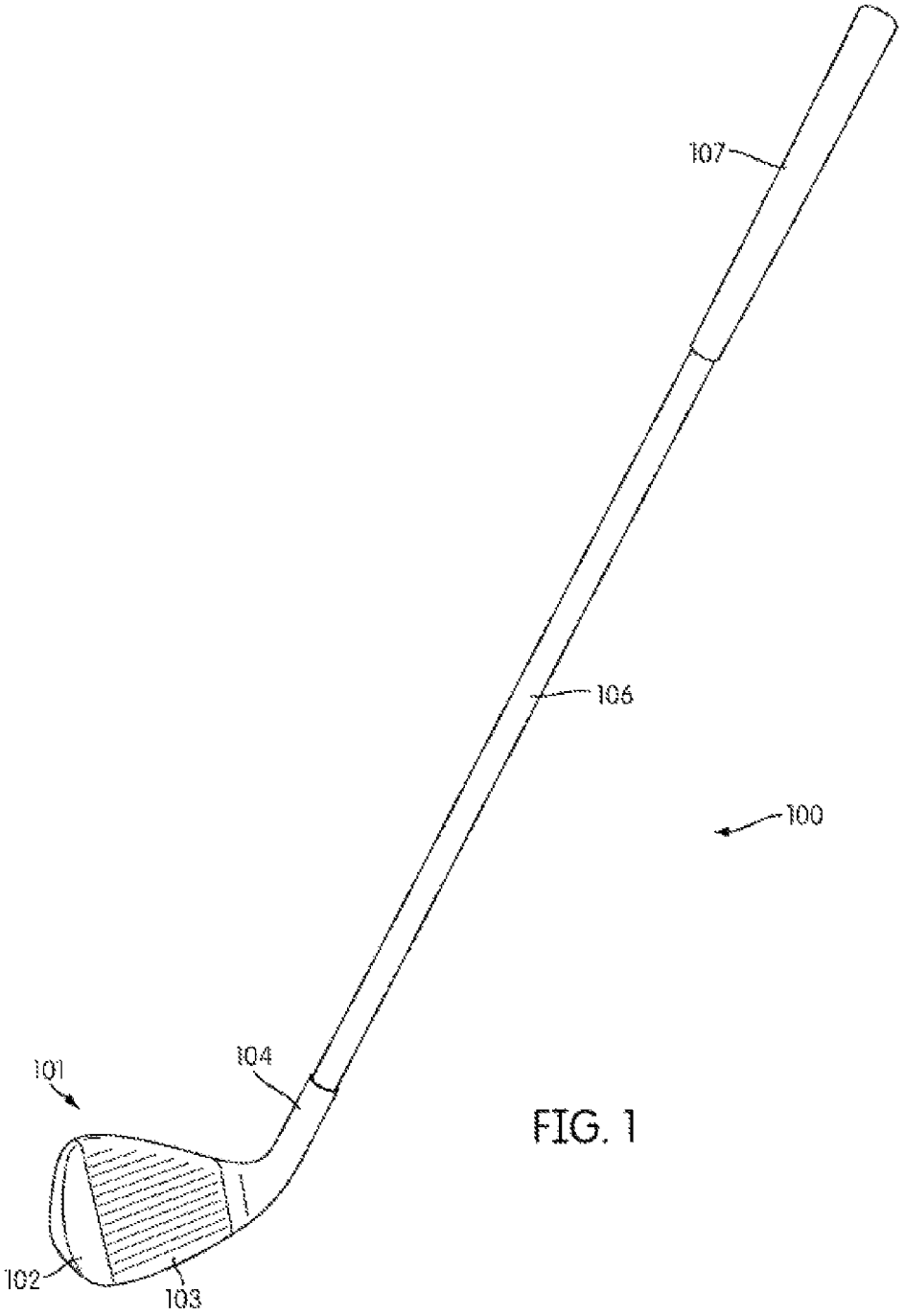
FIG. 1 is an illustrative embodiment of a golf club structure according to aspects of the disclosure.

The reader is advised that the various parts shown in these drawings are not necessarily drawn to scale.

DETAILED DESCRIPTION

The following description and the accompanying figures disclose features of golf club heads and golf clubs in accordance with examples of the present disclosure.

I. General Description of Example Golf Club Heads, Golf Clubs, and Methods in Accordance with this Disclosure As described above, aspects of this disclosure relate to iron-type golf club heads and golf clubs. Iron-type golf club heads according to at least some example aspects of this disclosure may include: (a) an iron-type golf club head body; (b) a ball striking face, or face plate; and (c) an adjustable or removable member which is removably engagable with the iron-type golf club head body.

According to aspects of this disclosure, the adjustable member may be configured so the top portion of the adjustable member and the bottom portion adjustable member provide different bounce or loft angles when the adjustable member is engaged with the iron-type golf club head body in a first and second orientation respectively. For example, a bottom portion of the adjustable member may define a first bounce angle when the adjustable member is engaged with the iron type golf club head body in a first orientation. Further, according to aspects of the disclosure, the adjustable member may be configured such that it may be engaged with the iron type golf club head body in a second orientation wherein the top portion of the adjustable member defines a second bounce angle. According to aspects of the disclosure, the second bounce angle may be different than the first. Further, according to aspects of the disclosure, the second orientation may be inverted (e.g., rotated 180°) relative to the first orientation.

Additional aspects of this disclosure relate to iron-type golf club structures that include golf club heads, e.g., of the types described above. Such iron-type golf club structures further may include one or more of: a shaft member attached to the club head (optionally via a separate hosel member or a hosel member provided as a part of one or more of the club head and/or shaft); a grip or handle member attached to the shaft member; etc.

Still additional aspects of this disclosure relate to methods for producing iron-type golf club heads and iron-type golf club structures in accordance with examples of this disclosure. Such methods may include, for example, one or more of the following steps in any desired order and/or combinations: (a) providing a golf club head body of the various types described above (including any or all of the various structures, features, and/or arrangements described above), e.g., by manufacturing or otherwise constructing the golf club head body, by obtaining it from a third party source, etc.; (b) engaging a shaft member with the golf club head body; and (c) engaging a grip member with the shaft member.

Given the general description of various example aspects of the disclosure provided above, more detailed descriptions of various specific examples of golf clubs and golf club head structures according to the disclosure are provided below.

II. Detailed Description of Example Golf Club Heads, Golf Club Structures, and Methods According to the Disclosure The following discussion and accompanying figures describe various example golf clubs and golf club head structures in accordance with the present disclosure. When the same reference number appears in more than one drawing, that reference number is used consistently in this specification and the drawings to refer to the same or similar parts throughout.

More specific examples and features of iron-type golf club heads and golf club structures according to this disclosure will be described in detail below in conjunction with the example golf club structures illustrated in FIGS. 1-11B.

FIG. 1 generally illustrates an example of an iron-type golf club 100 according to aspects of the disclosure. As seen in FIG. 1, the iron-type golf club 100 may include a golf club head 101 in accordance with the present disclosure. In addition to the golf club head 101, the overall golf club structure 100 of this example includes a hosel 104, a shaft member 106 received in and/or inserted into and/or through the hosel 104, and a grip or handle member (not shown) attached to the shaft member 106. Optionally, if desired, the hosel 104 may be eliminated and the shaft member 106 may be directly inserted into and/or otherwise attached to the golf club head 101 (e.g., through an opening provided in the top of the golf club head 101, through an internal hosel member (e.g., provided within an interior chamber defined by the golf club head 101), etc.). The hosel 104 may be integrally formed as part of the golf club head structure 101, or it may be separately formed and engaged therewith (e.g., by adhesives or cements; by welding, brazing, soldering, or other fusing techniques; by mechanical connectors; etc.). Conventional hosels and their inclusion in an iron type club head structure may be used without departing from this disclosure.

The shaft member 106 may be received in, engaged with, and/or attached to the golf club head 101 in any suitable or desired manner, including in conventional manners known and used in the art, without departing from the disclosure. As more specific examples, the shaft member 106 may be engaged with the golf club head 101 via the hosel 104 and/or directly to the golf club head structure 101, e.g., via adhesives, cements, welding, soldering, mechanical connectors (such as threads, retaining elements, or the like), etc.; through a shaft-receiving sleeve or element extending into the golf club head 101; etc. If desired, the shaft 106 may be connected to the golf club head 101 in a releasable manner using mechanical connectors to allow easy interchange of one shaft for another on the head.

The shaft member 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member (not shown) may be attached to, engaged with, and/or extend from the shaft member 106 in any suitable or desired manner, including in conventional manners known and used in the art, e.g., using adhesives or cements; via welding, soldering, brazing, or the like; via mechanical connectors (such as threads, retaining elements, etc.); etc. As another example, if desired, the grip or handle member (not shown) may be integrally formed as a unitary, one-piece construction with the shaft member 106. Additionally, any desired grip or handle member materials may be used without departing from this disclosure, including, for example: rubber materials, leather materials, rubber or other materials including cord or other fabric material embedded therein, polymeric materials, and the like.

Aspects of the disclosure relate to particular structures of the golf club head 101. According to aspects of the disclosure, the golf club head 101 may be constructed in any suitable or desired manner and/or from any suitable or desired materials without departing from this disclosure, including from conventional materials and/or in conventional manners known and used in the art. For example, the club head 101 and/or its various parts may be made by forging, casting, molding, and/or using other techniques and processes, including techniques and processes that are conventional and known in the art.

According to aspects of the disclosure, the golf club head 101 may be a blade type iron golf club head. A wide variety of overall club head constructions are possible without departing from this disclosure. For example, it is noted that the dimensions and/or other characteristics of a golf club head 101 according to examples of this disclosure may vary significantly without departing from the disclosure. For example, while the described configuration may be particularly useful in wedges (e.g., pitching wedges, lob wedges, gap wedges, sand wedges, etc.), the features described may be incorporated into any iron-type club head including, for example: iron-type hybrid clubs, driving irons, 0 through 10 irons, etc.

As seen in FIG. 1, the golf club head 101 may include a golf club head body 102, a ball striking face member 103. According to aspects of the disclosure, the ball striking face member 103 may be integral with the golf club head body 102. According to other aspects of the disclosure, the ball striking face member 103 may be separable from the golf club head body 102 (e.g., a face plate), and, further, configured to be engaged with the golf club head body 102.

For example, the golf club head body 102 may include a structure, such as a recess, notch or other configuration (not shown) for receiving the ball striking face member 103. Further, according to aspects of the disclosure, the perimeter of the ball striking face member 103 may be configured to engage with the corresponding structure of the golf club head body 102 (e.g., the recess, notch or other configuration for receiving the ball striking face member 109). The ball striking face member 103 may be engaged with the golf club head body 102 by press fitting, bonding with adhesives or cements, welding (e.g., laser welding), soldering, brazing, or other fusing techniques, mechanical connectors, etc.

As seen in FIG. 1, according to aspects of the disclosure, the ball striking face member 103 may have a generally trapezoidal shape which extends between the crown and sole of the golf club head 101 and, further, extends substantially between the toe and the heel of the golf club head 101. Of course, the ball striking face member 103 may have other configurations as well.

According to aspects of the disclosure, the ball striking face member 103 may be configured as a relatively thin sheet. Further, according to aspects of the disclosure, the ball striking face member 103 may be comprised of one or more materials. The material(s) of the ball striking face member 103 may be relatively durable to withstand the repeated impacts with the golf ball. For example, according to aspects of the disclosure, the ball striking face member 103 may be made of a high strength material with a low Young's Modulus. For example, according to aspects of the disclosure, the ball striking face member 103 may comprise a high strength steel. For example, a high strength steel, such as SUP 10, HT1770, etc. may be used. Further, other materials with similar characteristics and used in the art, such as titanium or other metals or alloys may be used as well.

According to aspects of the disclosure, and as best seen in FIG. 1, the ball striking face member 103 may include score lines. According to aspects of the disclosure, the ball striking face member 103 the plurality of score lines may extend generally horizontally across the ball striking face member 103. According to aspects of the disclosure, a score line may extend partially, substantially, or completely across the ball striking face member 103. According to aspects of the disclosure, the number of score lines and/or the dimensions of each of the score lines may be varied as desired. For example, according to aspects of the disclosure, the score lines may have a relatively square or rectangular cross-sectional shape. Alternatively, the portions of the ball striking face member 103 defining the score line may be tapered such that the cross-sectional shape of the score line may resemble a "V" or "U" shape, wherein the hole defined by the score line becomes narrower as it extends toward the club head body 102. The score lines may interact with the dimpled surface of the golf ball during the impact of the golf club head 101 with a golf ball (e.g., during a golf swing) and affect the aerodynamics of the golf ball during the golf shot. For example, the score lines may cause a spin (e.g., back spin) of the golf ball during the golf shot.

Figure 2:
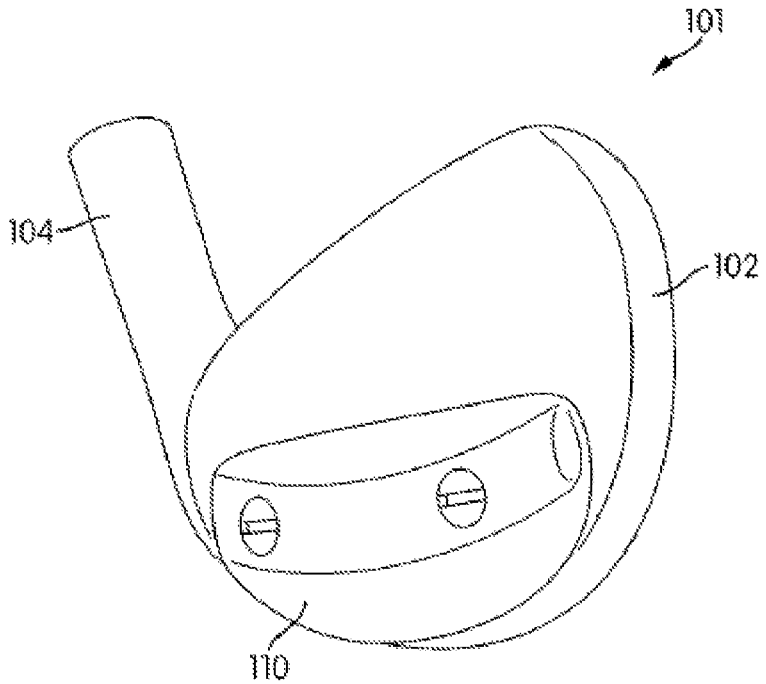
FIG. 2 is a rear perspective view of a golf club head according to aspects of the disclosure.
Figure 3:
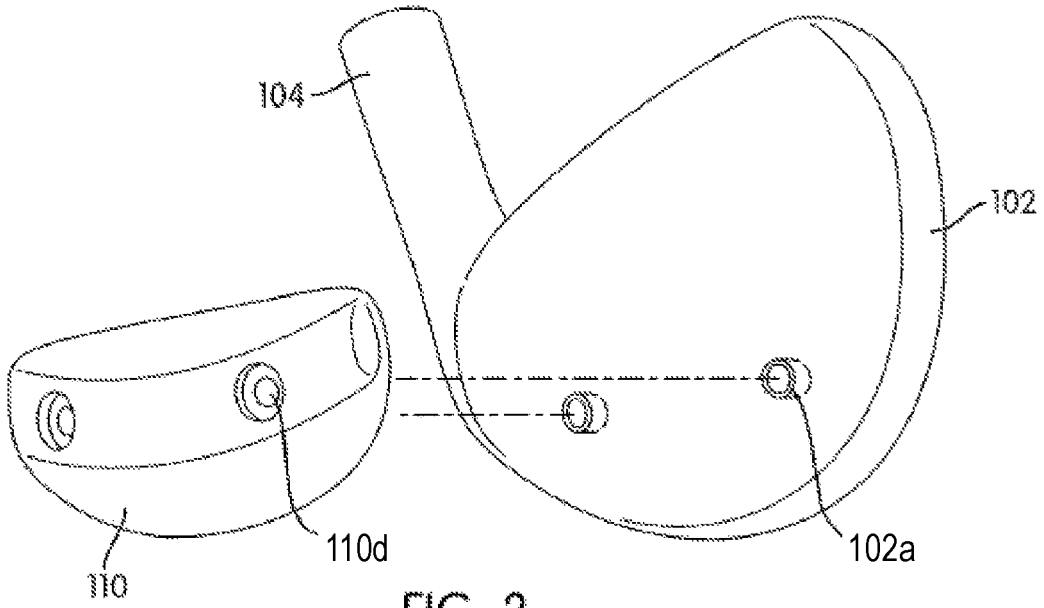
FIG. 3 is an exploded view of the golf club head shown in FIG. 2.
Figure 4A:
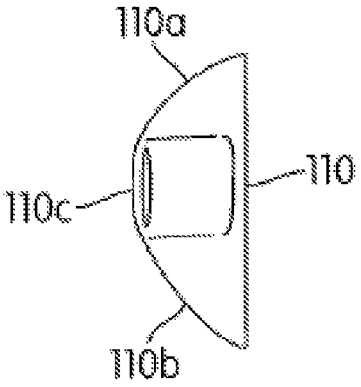
FIGS. 4A and 4B are end views of the adjustable member shown in FIG. 2 and in different orientations.
Figure 4B:
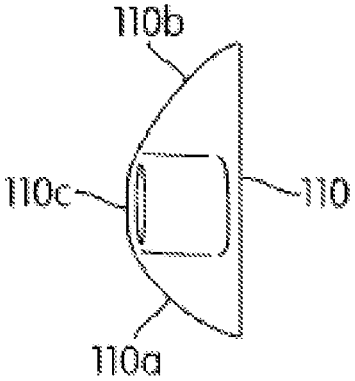

FIGS. 2-4 show various views of an illustrative embodiment of the golf club head 101 according to aspects of the disclosure. Specifically, FIG. 2 is a rear perspective view of the golf club head 101 according to aspects of the disclosure. FIG. 3 is an exploded view of the golf club head 101 shown in FIG. 2. FIGS. 4A and 4B are end views of the adjustable member of the golf club head 101.

Figure 5A:
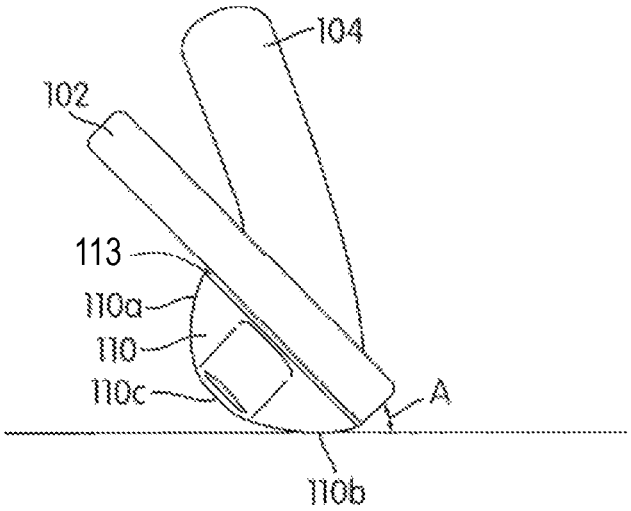
FIG. 5A is an end view of the golf club head shown in FIG. 2 with the adjustable member positioned in a first orientation.
Figure 5B:
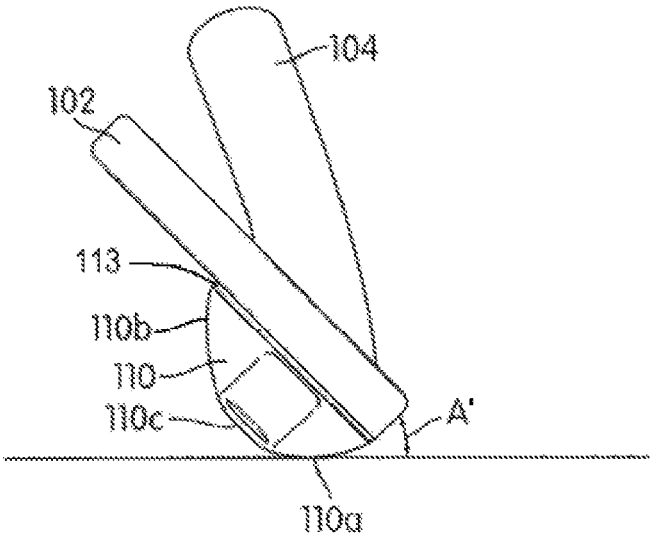
FIG. 5B is an end view of the golf club head shown in FIG. 2 with the adjustable member positioned in a second orientation.

According to aspects of the disclosure, the golf club head 101 may include an adjustable member 110. According to aspects of the disclosure, and as seen in FIGS. 2 and 3, the adjustable member 110 may be configured to form, at least in part, a rear surface of the golf club head 101 (e.g., a surface opposite the face of the ball striking member 103). Further, according to aspects of the disclosure, and as best seen in FIG. 5A-5B, the adjustable member 110 may be configured to form, at least in part, and a sole surface of the golf club head 101. According to aspects of the disclosure, the adjustable member 110 may be configured to define a bounce angle of the golf club head 101 and form at least a portion of the bounce of the golf club head 101.

Bounce angle is the angle inscribed by the leading edge of an iron type golf club head (e.g., a wedge), the sole of the club head, and a horizontal line under the sole (e.g., representing the ground). The bounce angle may be considered an indication of how much the sole of the golf club head lifts the leading edge. Further, the bounce defined by the bounce angle may be considered an indication of how much the trailing edge of the golf club head hangs below the leading edge of the golf club head.

Providing bounce in a golf club head may assist a golfer in controlling how far and how easily the golf club head penetrates the ground under the golf ball during a golf shot. In other words, providing bounce in a golf club head may aid a golfer in preventing a golf club head from digging into the turf during a golf shot when a golfer does not intend for the golf club head to do so. For example, a relatively large, or high, bounce angle (e.g., a bounce angle in the range of 12-16°) indicates a sole which lifts the leading edge significantly. Hence, the relatively high bounce angle may cause the sole of the golf club head to impact the ground first, keeping the leading edge of the golf club head from digging into the surface by causing the golf club head to "bounce" across the surface instead. Thus, the bottom of the golf club head may act similar to a bow of a boat preventing penetration into the ground and wherein a "thump" sound is created that represents the bounce on the sole of the club making the first contact with the ground. In contrast, a golf club head with a relatively small bounce angle, or no bounce angle, may allow the leading edge of the golf club head to contact the ground without interference. Hence, the relatively low bounce angle may allow the leading edge of the golf club head to more readily cut into the ground. It is noted that bounce, may be particularly useful in wedges (e.g., pitching wedges, gap wedges, lob wedges, sand wedges, etc.) because of the steep angles of ball striking member in such golf club heads.

Generally, golf club heads with more bounce may be more useful on a golf course with softer turf conditions and/or fluffy sand, because the greater amount of bounce may help prevent the golf club head's leading edge from digging to deeply into the ground (e.g., and, thereby, causing a "fat" shot or mishit). Alternatively, generally, golf club heads with less bounce may be more useful on a golf course with a harder turf and/or firmer sand in the sand traps, because the lower amount of bounce may assist the golf club head's leading edge in digging down into the turf and through the rest of the shot more easily. For example, if the golf course has a harder turf and/or firmer sand, a high bounce angle may prevent golf club head's leading edge from digging in and, therefore, the bounce may keep the leading edge of the golf club head too high off the ground/sand causing a "skull", or extremely thin golf shot that goes too far past its intended target. Additionally, generally, golf club heads with less bounce may be useful on thin grass and tight lies, whereas golf club heads with more bounce may be employed in deep rough or sand.

Further, in addition to the particular golf course conditions, a golfer's swing style may also contribute to a determination of the amount of bounce that should be provided in the golfer's golf club heads. For example, generally, golfers with steeper swings may prefer golf club heads with more bounce because the greater amount of bounce in the golf club heads may assist in preventing the golf club heads from digging too deeply in the ground on such golfers' downswings. Conversely, golfers who have flatter, more sweeping swings may prefer golf club heads with less bounce, because the smaller amount of bounce in the golf club heads may assist in preventing skidding off the ground with the golf club head and thereby making contact with the middle of the golf ball (e.g., "skulling" or "blading" a shot).

Therefore, it is understood that a variety of factors including a particular golfer's swing style, the conditions at a particular golf course, etc. may contribute to a determination of the bounce angle and the amount of bounce that should be provided in a golfer's golf club heads. It would be advantageous to be able to adjust the bounce angle and the amount of bounce provided in a golf club head. Hence, aspects of the disclosure, relate to golf club heads wherein the bounce angle and the amount of bounce provided in a golf club head are adjustable. For example, aspects of the disclosure, relate to a golf club head 101 including an adjustable member 110 which may be manipulated or otherwise adjusted to vary the bounce angle and the amount of bounce provided in the golf club head 101.

According to aspects of the disclosure, and as seen in FIGS. 2 and 3, the adjustable member 110 may be configured to engage with the golf club head body 102. For example, as shown in FIGS. 2 and 3, the adjustable member 110 may be configured to be engaged with the golf club head body 102 at a portion of the golf club head body 102 that is opposite the ball striking face member 103. According to aspects of the disclosure, the adjustable member 110 and the golf club head body 102 may be configured to be engaged by press fitting, mechanical connectors (e.g., snap fit locking and releasing members, threaded fasteners, etc.) or other securing means.

Further, as shown in FIG. 2, when engaged with the golf club head body 102, the adjustable member 110 may form, at least in part, a rear surface of the golf club head 101 (e.g., a surface opposite the face of the ball striking member 103). For example, as seen in the depicted embodiment, the adjustable member 110 may have a generally oval or elongated, circular shape that extends from proximate the toe to proximate the heel of the golf club head body 102. The curvature and shape of the adjustable member 110 may be varied as desired and also varied to correspond to the shape golf club head 101. Further, according to aspects of the disclosure, the adjustable member 110, may be configured to cover a portion of the rear portion of the golf club head body 102. For example, as seen in FIG. 2, the adjustable member 110 may cover, or substantially cover, a lower portion (e.g., a lower half) of the rear portion of the golf club head body 102. According to aspects of the disclosure, if desired, the rear portion of the golf club head body 102 may be configured to include a platform, recessed outline of adjustable member, etc. as an aid for aligning the adjustable member 110 in a correct position on the rear portion of the golf club head body 102. As can be further appreciated from FIGS. 2-11B, the adjustable member 110 extends substantially across the rear of the golf club head from proximate the heel to proximate the toe. Thus, a large and substantial surface is provided for affecting bounce.

FIGS. 4A and 4B show end views of an illustrative embodiment of the adjustable member 110 according to aspects of the disclosure. As seen in FIGS. 4A and 4B, the adjustable member 110 may include a first surface 110*a*, a second surface 110*b* and a third surface 110*c* positioned between the first surface 110*a* and the second surface 110*b*. Further, according to aspects of the disclosure, the first surface 110*a*, the second surface 110*b*, and the third surface 110*c* may be configured to provide the adjustable member 110 with a convex outer surface. For example, as seen in FIGS. 4A and 4B, the third surface 110*c* may be configured as a strip that extends in the heel to toe direction when the adjustable member 110 is engaged with the golf club head body 102. Further, according to aspects of the disclosure, the first surface 110*a* and the second surface 110*b* may be configured as inclined relative to the third surface 110*c*. For example, as seen in FIG. 2, when the adjustable member 110 is engaged with the golf club head body 102 in a first orientation, the first surface 110*a* may be an upper surface which is included between the third surface 110*c* and the golf club head body 102. Further, the second surface 110*b* may be a lower surface which is inclined between the third surface 110*c* and the golf club head body 102. As seen in FIG. 2, the first surface and the second surface are included in opposing directions (e.g., the one surface may be inclined and the other surface may be declined relative to a reference point). Hence, in the depicted embodiment, the first surface 110*a*, the second surface 110*b*, and the third surface 110*c* provide the adjustable member 110 with a convex outer surface that defines at least a portion of the rear of the golf club head 101. The first surface 110*a* and the second surface 110*b* may also be considered to confront one another and also be generally adjacent the third surface 110*c*.

The concave structure of the adjustable member 110 may provide additional depth to the golf club head 102. Of course, the depth of adjustable member 110 may be varied based on different factors including the material(s) of which the adjustable member 110 is comprised.

According to aspects of the disclosure, the adjustable member 110 may be solid, hollow or substantially filled. Further, as seen in FIG. 5B, the adjustable member 110 may include one or more apertures through which securing means, such as threaded fasteners, may be used to secure the adjustable member 110 to the club head body member 102 in removable or detachable fashion.

Further, according to aspects of the disclosure, the adjustable member 110 may be configured with a recess for receiving a separate weight member (e.g., a tungsten or lead weight). Thus, the adjustable member 110 may define an interior recess that may receive support the weight member (s) therein. External recesses on the adjustable member 110 may also be provided to support other weight members. The additional weight from the weight member may provide additional weight at a lower portion of the golf club head 101 and, thereby, further lower the center of gravity of the golf club head 101.

According to aspects of the disclosure, a gasket 113 may be provided between the adjusting member 110 and the golf club head body 102. For example, a gasket 113 may be configured to extend around an inner perimeter of the front face of the adjusting member 110 which is configured to engage with the golf club head body 102. The gasket 113 may provide additional vibration dampening features. The gasket 113 may also be shaped and dimensioned to provide a biasing force to the adjustable member 110 as may be desired when the adjustable member 110 is fastened to the golf club head body 102.

As best seen in FIG. 2, according to aspects of the disclosure, when engaged with the golf club head body 102, the adjustable member 110 may form, at least in part, a sole surface of the golf club head 101 and thereby define, at least in part, the bounce angle of the golf club head 101 and form, at least in part, a portion of the bounce of the golf club head 101. As seen in FIG. 2, when the adjustable member 110 is engaged with the golf club head body 102, the first surface 110*a* may be an upper surface which declines towards the third surface 110*c*, and the second surface 110*b* may be a lower surface which is inclined towards the third surface 110*c*. Hence, the second surface 110*b* may be configured to define, at least in part, the bounce angle of the golf club head 101 and form, at least in part, a portion of the bounce of the golf club head 101.

As discussed above, according to aspects of the disclosure, the adjustable member 110 may be configured to be engaged with the club head body 102. Further, according to aspects of the disclosure, the adjustable member 110 may be configured to be removablely engaged with the club head body 102. For example, according to aspects of the adjustable member 110 may be easily removed and reengaged with the club head body 102.

Hence, according to aspects of the disclosure, a plurality of different and interchangeable adjustable members 110 may be engaged with the club head body 102. Further, according to aspects of the disclosure, each of the plurality of different and interchangeable adjustable members 110 may be configured differently in order to provide the golf club head 101 with a distinct bounce and bounce angle. Therefore, according to aspects of the disclosure, the bounce and bounce angle of the golf club head 101 may be adjusted by engaging the golf club head body 102 with one of the plurality of different adjustable members 110. Thus, a kit may be formed of a golf club head body 102 and a plurality of different adjustable members 110.

According to aspects of the disclosure, the adjustable members 110 may be engaged with the golf club head body 102 by press fitting, or other mechanical connectors, such as threaded fasteners, spring loaded locking detents and corresponding recesses, etc. For example, as best seen in FIG. 3, the club head body 102 may have a series of protrusions 102*a* which extend from the rear of the golf club head body 102. Further, the adjustable member 110 may have a corresponding series of apertures 110*d* which extend through the adjustable member 110 for receiving the protrusions 102*a* of the golf club head body 102. Once the protrusions 102*a* of the golf club head body 102 are engaged with the apertures 110*d* of the adjustable member 110, the adjustable member 110 may be secured to the golf club head body 102. For example, the protrusions 102*a* of the golf club head body 102 may be hollow and internally threaded. Hence, the adjustable member 110 may be secured to the golf club head body 102 by a threaded fastener, such as a screw, which extends through the adjustable member 110 and into the threaded interior of the protrusions 102*a* of the golf club head body 102. According to aspects of the disclosure, the adjustable member 110 may be engaged with and secured to the golf club head body 102 by other means as well.

It is noted that while the above described embodiment discussed aspects of the disclosure with reference to a blade type iron, alternatively, if desired, the golf club head body 102 may be a perimeter weighted and/or cavity back type golf club head or other iron type golf club head structure without departing from this disclosure.

According to aspects of the disclosure, the adjustable member may be configured so the top portion and the bottom portion provide different bounce angles. For example, as described above, the second surface 110*b* of the adjustable member 110 may define a first bounce angle when the adjustable member 110 is engaged with the golf club head body 102 in a first orientation. Further, according to aspects of the disclosure, adjustable member 110 may be configured such that it may be engaged with the golf club head body 102 in a second orientation wherein the first surface 110*a* of the adjustable member 110 defines a second bounce angle. According to aspects of the disclosure, the second bounce angle may be different than the first. Further, it is noted, that according to aspects of the disclosure, the engagement of the adjustable member 110 with the golf club head body 102 may be seamless, or substantially seamless, in either the first or second orientation. Also, according to aspects of the disclosure, the second orientation may be inverted (e.g., rotated 180°) relative to the first orientation. The rotation may occur via a central point on the adjustable member 110.

FIGS. 5A and 5B are toe end views of such an embodiment of the golf club head 101. FIG. 5A illustrates the golf club head 101 when the adjustable member 110 is engaged with the golf club head body 102 in a first orientation. As seen in FIG. 5A, when the adjustable member 110 is engaged with the golf club head body 102 in a first orientation, the second surface 110*b* forms, at least in part, a sole surface of the golf club head 102 and, thereby, defines, at least in part, the bounce angle A of the golf club head 102 and forms, at least in part, a portion of the bounce of the golf club head 102. In contrast, FIG. 5B illustrates the golf club head 101 when the adjustable member 110 is engaged with the golf club head body 102 in a second orientation. As seen in FIG. 5B, when the adjustable member 110 is engaged with the golf club head body 102 in a second orientation, the first surface 110*a* forms, at least in part, a sole surface of the golf club head 102 and, thereby, defines, at least in part, the bounce angle A' of the golf club head 102 and forms, at least in part, a portion of the bounce of the golf club head 102. The bounce angle A illustrated in FIG. 5A and the bounce angle A' illustrated in FIG. 5B may be different and distinct bounce angles, thereby providing the golf club head 101 with two different bounce angles.

As seen by comparing FIGS. 5A with 5B, the shape and/or the incline of the first surface 110*a* and second surface 110*b* may be different. For example, the first surface 110*a* and the second surface 110*b* may be inclined to different degrees (e.g., one of first surface 110*a* or second surface 110*b* may have a greater incline relative to the third surface 110*c*). Additionally, or alternatively, one of first surface 110*a* or second surface 110*b* may have a more curved, or longer, surface compared with the other surface. Accordingly, as seen in FIGS. 5A and 5B, due to the different shapes and/or the inclines of the first surface 110*a* and second surface 110*b*, the bounce angles A and A' may be different.

The above described embodiment allows a single adjustable member to provide more than one different bounce angle when engaged with the golf club head body (e.g., depending on the orientation in which the adjustable member is engaged with the golf club head body). For example, a single, adjustable member may be used (e.g., removed, re-oriented, and reattached) to provide different bounce angles depending on the particular course, course conditions, golfer's ability, etc. without the need for an additional (e.g., a second) adjustable member to provide the different bounce angle.

Figure 6:
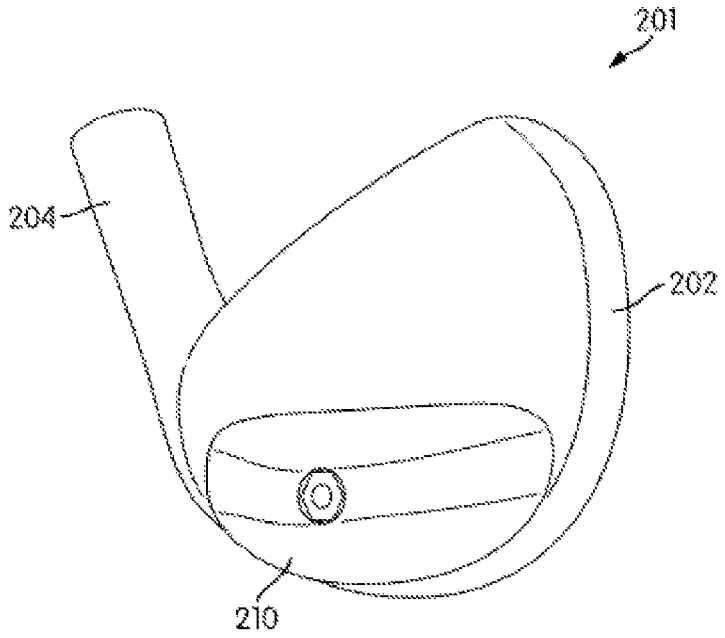
FIG. 6 is a rear perspective view of another golf club head according to aspects of the disclosure.
Figure 7:
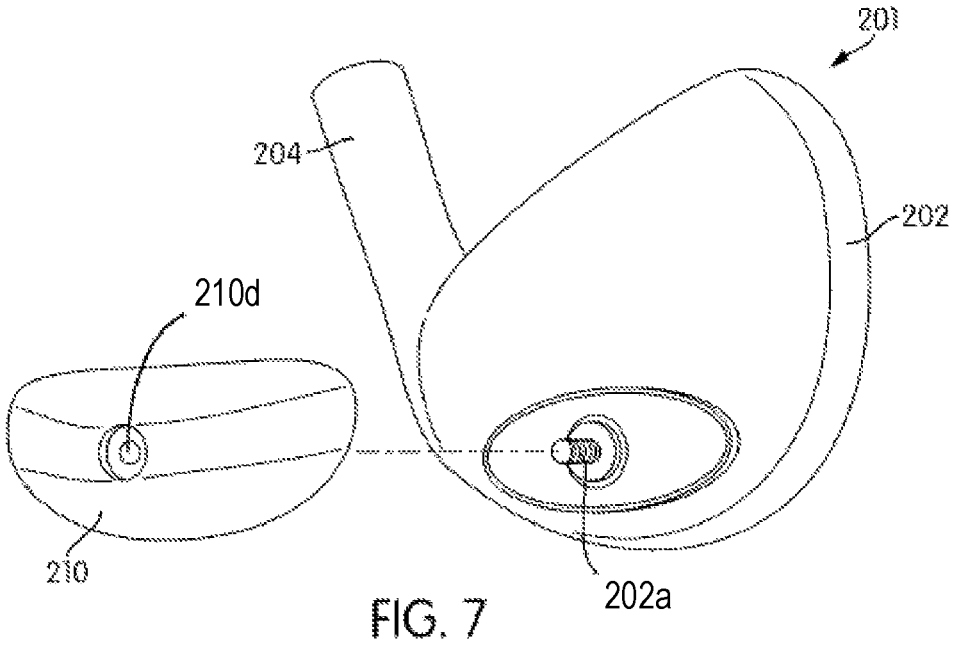
FIG. 7 is an exploded view of the golf club head shown in FIG. 6.
Figure 8:
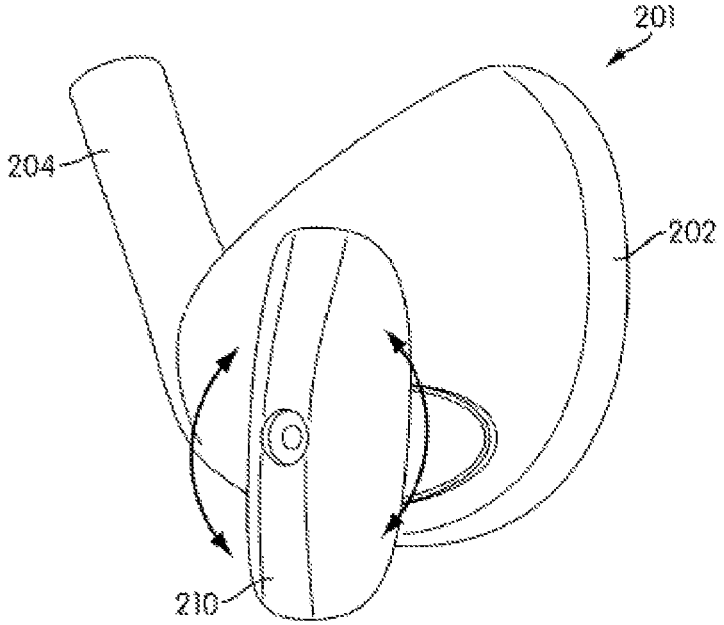
FIG. 8 is a rear perspective view of the golf club head shown in FIG. 6 with the adjustable member rotatable between a first orientation and second orientation.
Figure 9:
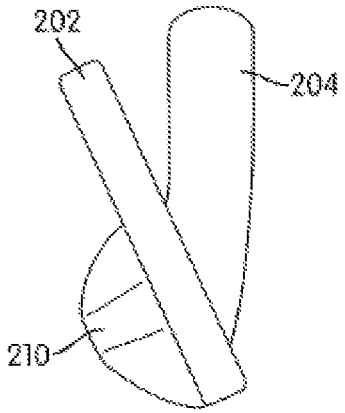
FIG. 9 is an end view of the golf club head shown in FIG. 6.

FIGS. 6-9 illustrate views of a golf club head 201 arranged in various configurations according to a second embodiment of this disclosure. It is noted that several aspects of the second embodiment are similar to features of the above recited embodiment and, therefore, for the sake of brevity, will not be reiterated here. Specifically, FIG. 6 is a rear perspective view of the golf club head 201 according to aspects of the disclosure. FIG. 7 is an exploded view of the golf club head 201 shown in FIG. 6. FIG. 8 is a rear perspective view of the golf club head 201 illustrating the adjustable member in a rotated position between a first orientation and a second orientation. FIG. 9 illustrates an end view of the golf club head 201 in the first orientation.

As seen in FIGS. 6-8, the golf club head 201 includes a single protrusion 202*a* extending from the rear of the golf club head body 202 and an adjustable member 210 includes a single aperture 210*d*. As seen in FIGS. 6-8, both the single protrusion 202*a* and a single aperture 210*d* may be centered or substantially centered in the heel toe direction of the golf club head 201. By providing a single protrusion 202*a* and a single aperture 210*d* in the manner shown in FIGS. 6-8, the adjustment of the adjustable member 210 may be accomplished by merely rotating the adjustable member 210. For example, the adjustable member 210 may be rotated while still engaged with the single protrusion 202*a*. Hence, in some embodiments, the adjustable member 210 may be rotated without removing it from the golf club head body 202 (e.g., not removing the adjustable member 210 from the single protrusion 202*a*).

For example, as discussed above, according to aspects of the disclosure, the adjustable member 210 may be engaged with the golf club head body 202 by mechanical connectors, such as threaded fasteners, spring loaded locking detents and corresponding recesses, etc. Therefore, according to aspect of the disclosure the golf club head 201 may include a washer and a nut which are configured to engage with the threaded portion of the single protrusion 202*a* in order to secure the adjustable member 210 to the golf club head body 202. Hence, in order to rotate the adjustable member 210, the washer and nut may be loosened and the adjustable member 210 may be rotated to the desired position (e.g., the first or second orientation described above). Once the adjustable member 210 is the appropriate position, the washer and nut may be tightened to secure the adjustable member 210 to the golf club head body 202.

Such an embodiment provides a relatively easy, less cumbersome and expedient method for adjusting the bounce and bounce angle of the golf club head 201 from a first bounce/bounce angle to the second bounce/bounce angle which is different from the first bounce/bounce angle. It is noted that while a threaded fastener is shown in the figures, other mechanical connectors such as spring loaded locking detents and corresponding recesses, etc. may be used as well. It is further noted that the orientation of the golf club, such as bounce, may be changed with a single adjustable member and not require a separate member to adjust orientation.

Figure 10A:
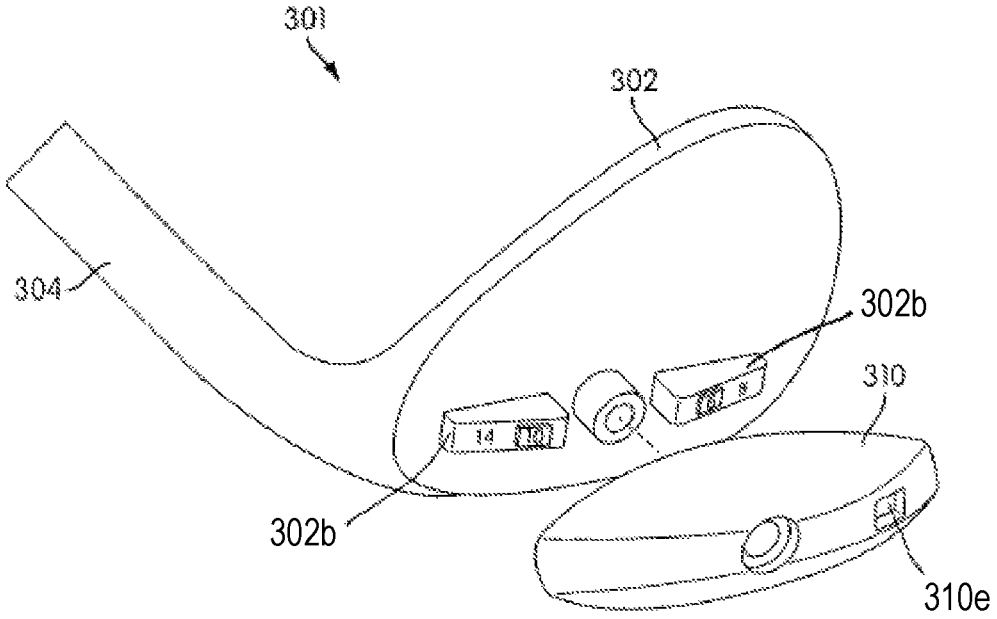
FIG. 10A is an exploded view of another golf club head according to aspects of the disclosure with a first adjustable member positioned in a first orientation.
Figure 10B:
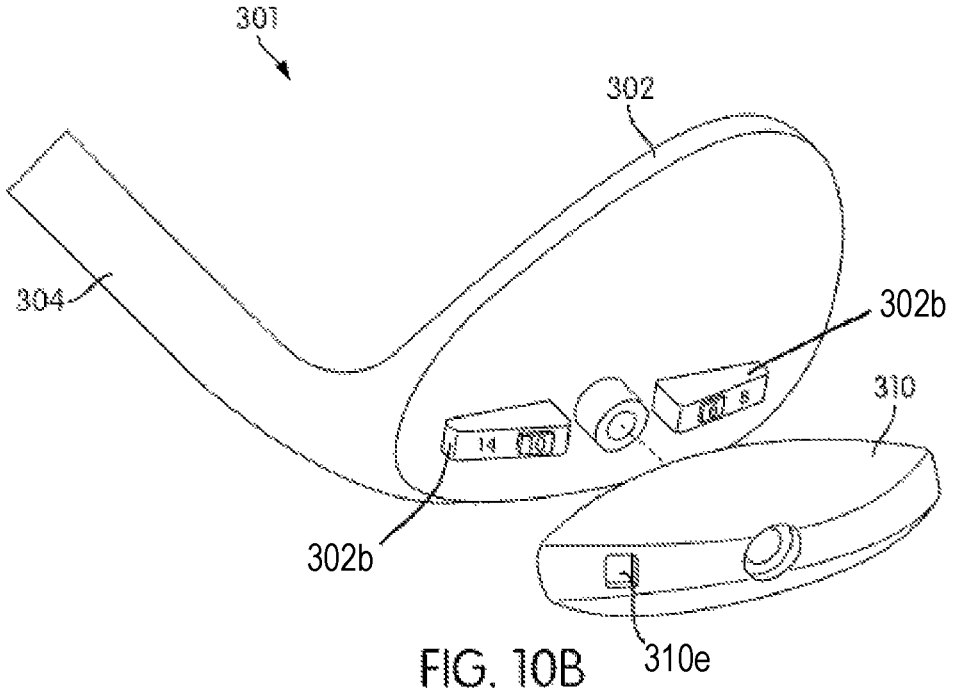
FIG. 10B is an exploded view of the golf club head shown in FIG. 10A with a first adjustable member positioned in a second orientation.
Figure 11A:
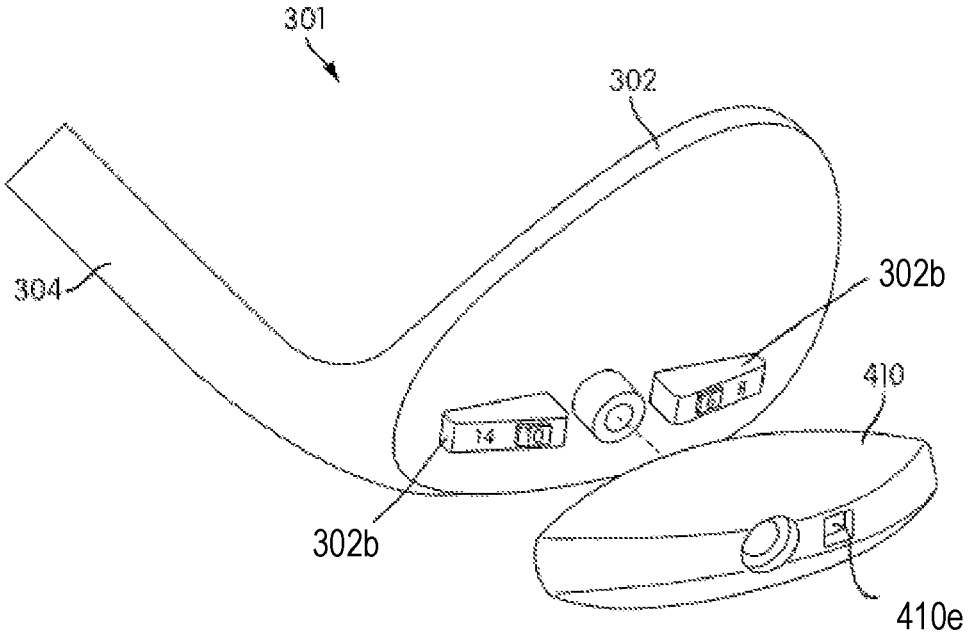
FIG. 11A is an exploded view of the golf club head shown in FIG. 10A with a second adjustable member positioned in a first orientation.
Figure 11B:
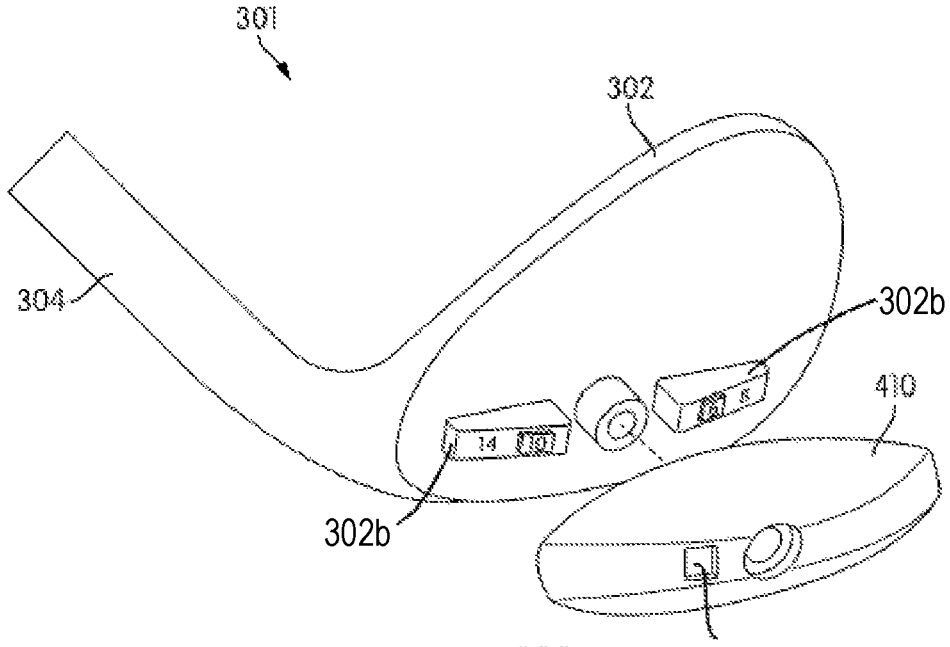
FIG. 11B is an exploded view of the golf club head shown in FIG. 10A with a second adjustable member positioned in a second orientation.

FIGS. 10A-11B illustrate views of a golf club head 301 arranged in various configurations according to a third embodiment of this disclosure. It is noted that several aspects of the third embodiment are similar to features of the above recited embodiment and, therefore, for the sake of brevity, will not be reiterated here. Specifically, FIG. 10A is a rear perspective exploded view of the golf club head 301 with an adjustable member 310 in a first orientation according to aspects of the disclosure. FIG. 10B is a rear perspective exploded view of the golf club head 301 with an adjustable member 310 in a second orientation according to aspects of the disclosure. FIG. 11A is a rear perspective exploded view of the golf club head 301 with an adjustable member 410 in a first orientation according to aspects of the disclosure. FIG. 11B is a rear perspective exploded view of the golf club head 301 with an adjustable member 410 in a second orientation according to aspects of the disclosure.

As seen in FIGS. 10A-10B, the golf club head 301 includes an adjustable member 310 which has a window or opening 310*e*. Further, as seen in FIGS. 10A-10B, the golf club head 301 includes one or more indicator structures 302*b*. Further, the indicator structures 302*b* may include an indicator which provides information about the golf club head 301. For example, the indicator structure 302*b* may include an indicator which provides information about the bounce angle of the golf club head 301. Alternatively, the indicator structure 302*b* may include an indicator which provides information about the loft angle of the golf club head 301. The indicator structure may be removably attached to the golf club head wherein different sets of indicators and adjustable members can be used with the golf club head.

According to aspects of the disclosure, the window 310*e* in the adjustable member 310 and the one or more indicator structures 302*b* may be configured such that when the adjustable member 310 is engaged with the golf club head body 302 in a first particular orientation, the indicator of the indicator structure 302*b* displays data which indicates a characteristic of the golf club head 301 that is created when the adjustable member 310 is engaged with the golf club head body 302 in that first particular orientation. Further, according to aspects of the disclosure, the window 310*e* in the adjustable member 310 and the one or more indicator structures 302*b* may be configured such that when the adjustable member 310 is engaged with the golf club head body 302 in a second particular orientation, the indicator of the indicator structure 302*b* displays data which indicates a characteristic of the golf club head 301 that is created when the adjustable member 310 is engaged with the golf club head body 302 in that second particular orientation. It is noted that the first particular orientation and the displayed characteristic(s) created by the first particular orientation may be different from the second particular orientation and the displayed characteristic(s) created by the second particular orientation.

For example, in the embodiment shown in FIG. 10A, the golf club head body 302 includes two indicator structures 302*b*. The first indicator structure 302*b* includes two indicators, a first indicator which indicates a bounce angle of 8° and a second indicator which indicates a bounce angle of 6°. Further, the second indicator structure 302*b* includes two indicators, a first indicator which indicates a bounce angle of 14° and a second indicator which indicates a bounce angle of 10°. Further, as seen in FIG. 10A, when the adjustable member 310 is engaged with the golf club head body 302 in a first particular orientation, a bounce angle of 8° is created by the engagement between the adjustable member 310 is engaged with the golf club head body 302. Further, the window 310*e* is configured to align with the indicator of the indicator structure 302*b* that displays a bounce angle of 8°.

Conversely, as seen in FIG. 10B, when the adjustable member 310 is engaged with the golf club head body 302 in a second particular orientation (e.g., the adjustable member 310 is inverted relative to the first particular orientation), a bounce angle of 14° is created by the engagement between the adjustable member 310 is engaged with the golf club head body 302. Further, when the adjustable member 310 is engaged with the golf club head body 302 in this second particular orientation, the window 310*e* is configured to align with the indicator of the indicator structure 302*b* that displays a bounce angle of 14°.

Hence, it is understood that the adjustable member 310 may be engaged with the golf club head body 302 in multiple different orientations which create different characteristics of the golf club head 301 and that the adjustable member 310 and the golf club head body 302 are configured such that the appropriate indicator which corresponds to the characteristics created by the engagement of the adjustable member 310 and the golf club head body 302 in that particular orientation is displayed through an window or opening in the adjustable member.

FIG. 11A illustrates an adjustable member 410 which is configured such that when it is engaged with the golf club head body 302 in a first particular orientation, a bounce angle of 6° is created by the engagement between the adjustable member 410 is engaged with the golf club head body 302. Further, the window 410*e* is configured to align with the indicator of the indicator structure 302*b* that displays a bounce angle of 6°. Conversely, as seen in FIG. 11B, when the adjustable member 410 is engaged with the golf club head body 302 in a second particular orientation (e.g., the adjustable member 410 is inverted relative to the first particular orientation), a bounce angle of 10° is created by the engagement between the adjustable member 410 is engaged with the golf club head body 302. Further, when the adjustable member 410 is engaged with the golf club head body 302 in this second particular orientation, the window 410*e* is configured to align with the indicator of the indicator structure 302*b* that displays a bounce angle of 10°.

It is noted that the indicator structures 302*b* may be configured to act as an alignment guide to ensure that the adjustable members 310/410 are engaged with the golf club head body 302 to provide the appropriate characteristics that are displayed. Further, the adjustable members 310/410 may be configured with a recess which correspond to the indicator structures 302*b* and are configured to receive the indicator structures 302*b* when the adjustable members 310/410 are engaged with the golf club head body 302. Thus, the golf club head provides a cooperating indicia structure between the club head body and the adjustable member to indicate a particular bounce characteristic of the golf club head.

It is noted that other methods of indicating the different characteristics of the golf club head that are created when the adjustable member 310 is engaged with the golf club head body 302 may be used as well. According to one embodiment of the disclosure, the indicator may be positioned on the adjustable member 310. For example, the indicator of a bounce angle of 8° may be positioned or inscribed on the adjustable member 310. Further, the indicator of a bounce angle of 10° may be positioned or inscribed on the adjustable member in an inverted orientation. In this way, the golfer may be able to distinguish between the different bounce angles created by the engagement between the adjustable member 310 and the golf club head body 302 by simply determining which of the indicators is "right side up" (i.e., not inverted). In other words, which ever indicator is "right side up" will indicate to the golfer the current bounce angle that is created by the engagement between the adjustable member 310 and the golf club head body 302.

The disclosure herein includes several different embodiments. It is understood that the various features of the different embodiments may be combined as desired.

III. CONCLUSION

The present disclosure is described above and in the accompanying drawings with reference to a variety of example structures, features, elements, and combinations of structures, features, and elements. The purpose served by the disclosure, however, is to provide examples of the various features and concepts related to the disclosure, not to limit the scope of the disclosure. One skilled in the relevant art will recognize that numerous variations and modifications may be made to the embodiments described above without departing from the scope of the present disclosure, as defined by the appended claims. For example, the various features and concepts described above in conjunction with figures may be used individually and/or in any combination or subcombination without departing from this disclosure.

We claim:

1. A golf club head comprising:

a club head body; and a plurality of adjustable members configured to be engaged with the club head body;

wherein:

the plurality of adjustable members are rotatable and reconfigurable between at least a first position and a second position different than the first position;

the club head body comprises a fastening protrusion extending from a rear of the club head body, a second protrusion, and a third protrusion;

each adjustable member of the plurality of adjustable members comprises an aperture configured to receive the fastening protrusion, a first recess, and a second recess;

when each adjustable member of the plurality of adjustable members is engaged with the body in a first position, the first recess is configured to receive the second protrusion and the second recess is configured to receive the third protrusion;

when each adjustable member of the plurality of adjustable members is engaged with the body in a second position, the first recess is configured to receive the third protrusion and the second recess is configured to receive the second protrusion;

wherein the plurality of adjustable members comprises at least a first adjustable member configured to be engaged with the club head body and a second adjustable member configured to be engaged with the club head body;

the first adjustable member further comprises a window;

the club head body comprises a first indicator providing a first bounce angle, wherein the first indicator aligns with, and displays through the window when the first adjustable member is oriented in the first position, and a second indicator providing a second bounce angle different from the first bounce angle, wherein the second indicator aligns with, and displays through the window when the first adjustable member is oriented in the second position;

the first indicator is located on the second protrusion of the club head body; and the second indicator is located on the third protrusion of the club head body.

2. The golf club head of claim 1, further comprising: a fastener that engages both the fastening protrusion of the body and the aperture of one of the adjustable members of the plurality of adjustable members, wherein the fastener helps secure said adjustable member to the body.

3. The golf club head of claim 2, wherein the fastener comprises a mechanism selected from the group consisting of: a threaded fastener, a press-fitting mechanism, and spring loaded locking detents and corresponding recesses.

4. The golf club head of claim 2, wherein:

the fastening protrusion is hollow and internally threaded;

the fastener is a threaded fastener;

said adjustable member is immovable when the threaded fastener is fully engaged with the internally threaded fastening protrusion; and said adjustable member is rotatable and reconfigurable between the first position and the second position when the threaded fastener is partially engaged or disengaged with the internally threaded fastening protrusion.

5. The golf club head of claim 1, further comprising: a gasket disposed between one of the adjustable members of the plurality of adjustable members and the golf club head body.

6. The golf club head of claim 5, wherein the gasket is configured to extend around an inner perimeter of a front face of one of the adjustable members of the plurality of adjustable members.

7. The golf club head of claim 1, wherein:

the second adjustable member further comprises a window;

the club head body comprises a third indicator providing a third bounce angle different from the first and second bounce angle, wherein the third indicator aligns with, and displays through the window when the second adjustable member is oriented in the first position, and a fourth indicator providing a fourth bounce angle different from the third bounce angle, wherein the fourth indicator aligns with, and displays through the window when the second adjustable member is oriented in the second position;

the third indicator is located on the second protrusion of the club head body; and the fourth indicator is located on the third protrusion of the club head body.

8. The golf club head of claim 1, wherein:

the first protrusion and the second protrusion prevent one of the adjustable members of the plurality of adjustable members from rotating by engaging with the first and second recesses when said adjustable member is oriented in each of the first position and the second position; and the first protrusion and the second protrusion allow rotation and reconfiguration of the adjustable member when the aperture of said adjustable member is only partially engaged with the fastening protrusion of the body.

9. The golf club head of claim 1, wherein:

at least one adjustable member of the plurality of adjustable members defines at least one recess configured to receive a weight member; and the at least one recess opens towards an exterior of the at least one adjustable member of the plurality of adjustable members.

10. The golf club head of claim 1, wherein:

at least one adjustable member of the plurality of adjustable members defines at least one recess configured to receive a weight member; and the at least one recess opens towards an interior side of the at least one adjustable member of the plurality of adjustable members.

11. A golf club head comprising:

a club head body; and a plurality of adjustable members configured to be engaged with the club head body;

wherein:

the plurality of adjustable members are rotatable and reconfigurable between at least a first position and a second position different than the first position;

the club head body comprises a fastening protrusion extending from a rear of the club head body, a second protrusion, and a third protrusion;

each adjustable member of the plurality of adjustable members comprises an aperture configured to receive the fastening protrusion, a first recess, and a second recess;

each adjustable member of the plurality of adjustable members is rotatable and reconfigurable without fully disengaging the aperture from the fastening protrusion;

when each adjustable member of the plurality of adjustable members is engaged with the body in a first position, the first recess is configured to receive the second protrusion and the second recess is configured to receive the third protrusion;

when each adjustable member of the plurality of adjustable members is engaged with the body in a second position, the first recess is configured to receive the third protrusion and the second recess is configured to receive the second protrusion;

the plurality of adjustable members comprises at least a first adjustable member configured to be engaged with the club head body, and a second adjustable member configured to be engaged with the club head body;

the first adjustable member further comprises a window;

the club head body comprises a first indicator providing a first bounce angle, wherein the first indicator aligns with, and displays through the window when the first adjustable member is oriented in the first position, and a second indicator providing a second bounce angle different from the first bounce angle, wherein the second indicator aligns with, and displays through the window when the first adjustable member is oriented in the second position;

the first indicator is located on the second protrusion of the club head body; and the second indicator is located on the third protrusion of the club head body.

12. The golf club head of claim 11, further comprising: a fastener that engages both the fastening protrusion of the body and the aperture of one of the adjustable members of the plurality of adjustable members, wherein the fastener helps secure said adjustable member to the body.

13. The golf club head of claim 12, wherein the fastener comprises a mechanism selected from the group consisting of: a threaded fastener, a press-fitting mechanism, and spring loaded locking detents and corresponding recesses.

14. The golf club head of claim 12, wherein:

the fastening protrusion is hollow and internally threaded;

the fastener is a threaded fastener;

said adjustable member is immovable when the threaded fastener is fully engaged with the internally threaded fastening protrusion; and said adjustable member is rotatable and reconfigurable between the first position and the second position when the threaded fastener is partially engaged or disengaged with the internally threaded fastening protrusion.

15. The golf club head of claim 11, further comprising: a gasket disposed between one of the adjustable members of the plurality of adjustable members and the golf club head body.

16. The golf club head of claim 15, wherein the gasket is configured to extend around an inner perimeter of a front face of one of the adjustable members of the plurality of adjustable members.

17. The golf club head of claim 11, wherein:

the second adjustable member further comprises a window;

the club head body comprises a third indicator providing a third bounce angle different from the first and second bounce angle, wherein the third indicator aligns with, and displays through the window when the second adjustable member is oriented in the first position, and a fourth indicator providing a fourth bounce angle different from the third bounce angle, wherein the fourth indicator aligns with, and displays through the window when the second adjustable member is oriented in the second position;

the third indicator is located on the second protrusion of the club head body; and the fourth indicator is located on the third protrusion of the club head body.

18. The golf club head of claim 11, wherein:

the first protrusion and the second protrusion prevent one of the adjustable members of the plurality of adjustable members from rotating by engaging with the first and second recesses when said adjustable member is oriented in each of the first position and the second position; and the first protrusion and the second protrusion allow rotation and reconfiguration of said adjustable member when the aperture of the adjustable member is only partially engaged with the fastening protrusion of the body.

19. The golf club head of claim 11, wherein:

at least one adjustable member of the plurality of adjustable members defines at least one recess configured to receive a weight member; and the at least one recess opens towards an exterior side of the at least one adjustable member of the plurality of adjustable members.

20. The golf club head of claim 11, wherein:

at least one adjustable member of the plurality of adjustable members defines at least one recess configured to receive a weight member; and the at least one recess opens towards an interior side of the at least one adjustable member of the plurality of adjustable members.

* * * * *